US012588774B2

(12) United States Patent
Zwerin et al.

(10) Patent No.: US 12,588,774 B2
(45) Date of Patent: Mar. 31, 2026

(54) INFLATABLE PILLOW, COMPARTMENTAL PILLOW, AND PILLOW DISPENSER

(71) Applicant: The United States Government as represented by the Department of Veterans Affairs, Washington, DC (US)

(72) Inventors: Suzanne M. Zwerin, Cincinnati, OH (US); David A. Parrott, Cincinnati, OH (US)

(73) Assignee: THE UNITED STATES GOVERNMENT AS REPRESENTED BY THE DEPARTMENT OF VETERANS AFFAIRS, Washington, DC (US)

( * ) Notice: Subject to any disclaimer, the term of this patent is extended or adjusted under 35 U.S.C. 154(b) by 693 days.

(21) Appl. No.: 17/972,808

(22) Filed: Oct. 25, 2022

(65) Prior Publication Data

US 2023/0126976 A1 Apr. 27, 2023

Related U.S. Application Data

(60) Provisional application No. 63/271,344, filed on Oct. 25, 2021.

(51) Int. Cl.
*A47G 9/10* (2006.01)
*A47G 9/00* (2006.01)

(52) U.S. Cl.
CPC ..... *A47G 9/1027* (2013.01); *A47G 2009/003* (2013.01)

(58) Field of Classification Search
CPC .. A47G 9/10; A47G 9/1027; A47G 2009/003; A61G 7/065; A61G 7/072
See application file for complete search history.

(56) References Cited

U.S. PATENT DOCUMENTS 3,428,974 A * 2/1969 Stuart ..... A47C 27/10 5/710
4,247,963 A * 2/1981 Reddi ..... A47C 27/10 5/687
5,044,030 A * 9/1991 Balaton ..... A47C 27/081 5/687
5,661,862 A 9/1997 Ryndak
5,771,514 A 6/1998 Wilhoit
5,809,597 A * 9/1998 Shaw ..... A61G 7/0755 5/640
6,000,079 A * 12/1999 Dranger ..... A47C 4/54 425/522
6,131,219 A * 10/2000 Roberts ..... A47G 9/1027 5/636
6,175,978 B1 1/2001 Nizzi et al.
(Continued)

*Primary Examiner* — Fredrick C Conley
(74) *Attorney, Agent, or Firm* — Ballard Spahr LLP

(57) ABSTRACT

A plurality of inflatable pillows. Each pillow has at least one chamber. The chamber defines first and second edges oppositely disposed. Each pillow also has a valve providing fluid communication with the chamber for inflating and deflating the chamber. The first edge of one pillow is connect to a second edge of another pillow to form a continuous web. The pillows may form a continuous web and be dispensed from a device. Separation of the pillows one from another is enabled by perforations between edges of the pillows forming the web or tearing or cutting between edges of the pillows forming the web.

16 Claims, 12 Drawing Sheets

(56) References Cited

U.S. PATENT DOCUMENTS

| | | | | |
|---|---|---|---|---|
| 7,509,699 | B1 * | 3/2009 | Tresenfeld | A47C 27/10 5/413 AM |
| 10,858,210 | B2 | 12/2020 | Wetsch | |
| 2007/0169274 | A1 * | 7/2007 | Boso | A47C 27/081 5/706 |

* cited by examiner

INFLATABLE PILLOW, COMPARTMENTAL PILLOW, AND PILLOW DISPENSER

CROSS REFERENCE TO RELATED APPLICATION

This application is based upon and claims priority to U.S. Provisional Application No. 63/271,344 filed Oct. 25, 2021, which application is hereby incorporated by reference herein.

FIELD OF THE INVENTION

This invention concerns disposable, gas-filled pillows and a dispenser for dispensing and inflating gas filled pillows.

BACKGROUND

Proper body positioning post-operation or injury plays an important role in patient healing and pain management. During recovery, it is challenging to support head, limbs or trunk in a stable, comfortable position using traditional generic pillows. Often, multiple pillows and rolled-up towels are used for patient support, and still, an effective solution remains elusive. It may also be difficult to find enough pillows to accommodate each patient and requires additional time to locate pillows. Furthermore, pillows can spread infection if not properly cleaned and disinfected between uses. There is also the question of continued care, healing and recovery, once the patient is discharged from the hospital. It is unlikely that the supporting pillow arrangement, established by skilled nurses in the hospital setting, can or will be effectively reproduced in the patient's home. There is clearly a need for a pillow support apparatus and a dispenser which will address the current disadvantages associated with the use of generic pillows.

SUMMARY

The invention concerns a plurality of inflatable pillows. In one example, each pillow of the plurality of inflatable pillows comprises at least one chamber defining first and second edges oppositely disposed. Each pillow also comprises a first valve. The first valve provides fluid communication with said at least one chamber for inflating and deflating the at least one chamber. The first edge of at least one of the pillows is connected to a second edge of another pillow thereby forming a continuous web.

In an example embodiment, the first edge of the at least one of the pillows is connected to the second edge of another of the pillows along a line of perforations between the first and second edges.

In an example embodiment, the first edge of the at least one of the pillows is connected to the second edge of another pillow along an adjoining edge having a thickness that is thinner than a thickness of the first edge and the second edge.

In an example embodiment, the web is coiled into a roll comprising the plurality of inflatable pillows.

In an example embodiment, the roll includes a free end configured to dispense from a dispensing device.

In an example embodiment, the first valve comprises a flat tube and an adhesive seal.

In an example embodiment, the at least one chamber is formed of paper tissue with a polyester backing or natural and synthetic fabrics with a polymer backing or textured polymer films.

In a further example embodiment, the plurality of pillows further comprises a plurality of support chambers overlying a base chamber. At least one of the support chambers comprises an intermediate chamber. The intermediate chamber is positioned between two of the support chambers. The first valve is positioned in the intermediate chamber. A second valve is positioned in the base chamber or a support chamber other than the intermediate chamber. A plurality of ducts provide fluid communication between the base chamber and a respective one of the support chambers other than said intermediate chamber, said ducts permitting inflating and deflating said base chamber and said support chambers through said second valve.

The invention further encompasses a device for dispensing a web. The device comprises a housing including an outlet and a roller proximate to the outlet. A pinch roller is oppositely disposed the roller. A gear train is driven by a pinion coupled to the roller. The gear train includes a Geneva wheel configured to allow a predetermined length of the web to advance through the outlet.

In an example embodiment, the web comprises a plurality of inflatable pillows. Each inflatable pillow of the plurality of inflatable pillows is connected to at least one other inflatable pillow.

In a further example embodiment, the predetermined length is equal to a width of an inflatable pillow of the plurality of inflatable pillows.

In a further example embodiment, the predetermined length is equal to a length of an inflatable pillow of the plurality of inflatable pillows.

In an example embodiment, the gear train further includes a gear driven by the pinion. The gear includes a pin configured to engage a slot of a plurality of slots in the Geneva wheel when the gear rotates.

In an example embodiment, the Geneva mechanism is configured to index the gear to allow the predetermined length of the web to dispense through the outlet for each 90 degree rotation of the gear.

In an example embodiment, the device further comprises a resistance device configured to provide a resistance force on the gear train to cause a tensioning force on the web.

In an example embodiment, the device further comprises a cutter proximate to the outlet.

In an example embodiment, the device further comprises an inflator adapted to inflate the pillow.

DETAILED DESCRIPTION

Figure 1:
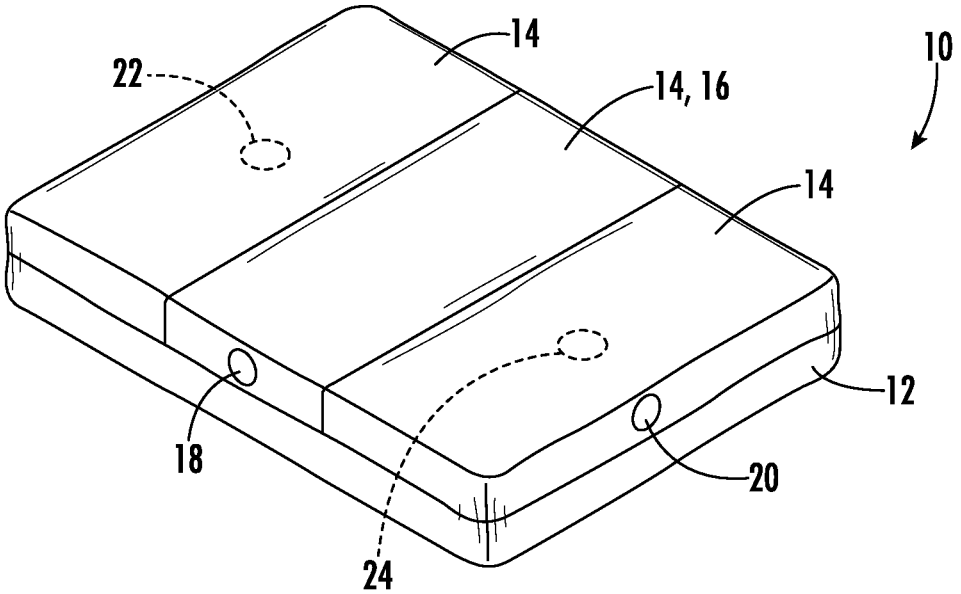
FIG. 1 is an isometric view of an example embodiment of an inflatable pillow according to the invention.

The invention concerns an inflatable pillow, for example, one that might be used in hospitals and which can be discarded or recycled after use or given to the patient for home care and therapy after discharge. An example pillow 10 is shown in FIG. 1 and comprises a base chamber 12. A plurality of support chambers 14, in this example, three support chambers, overlie and are attached to the base chamber 12. In use the base chamber 12 interfaces with a support surface, such as a bed (not shown) and the support chambers contact the patient (not shown). At least one of the support chambers 14 comprises an intermediate chamber 16, the intermediate chamber being positioned between two of the support chambers. The chambers comprising pillow 10 may be advantageously formed of a fabric coated with thermoplastic polyurethane material or nylon to provide impermeable, hermetic characteristics so that the chambers sustain a desired pressure at a low leak rate. The thermoplastic coating allows the pillow seams to be heat sealed. Alternatively, the pillow 10 may be formed of a paper tissue, such as cellulose, with a polyester backing. In another example, the pillow 10 may be formed of natural and synthetic fabrics with polymer backing or textured polymer films. It is further desired that the pillow 10 be hypoallergenic. While any method for creating a strong, air-tight seal may be used to form the seams of the pillow 10, some examples may include ultrasonic welding, heat welding, adhesives, or chemical weld-bonding agents.

Figure 2:
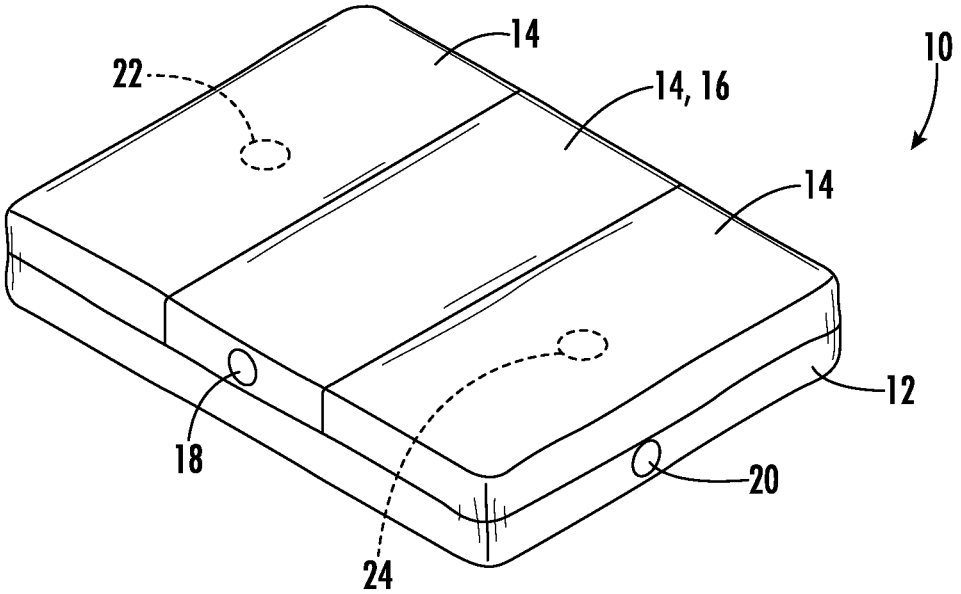
FIG. 2 is an isometric view of another example embodiment of an inflatable pillow according to the invention.
Figure 3:
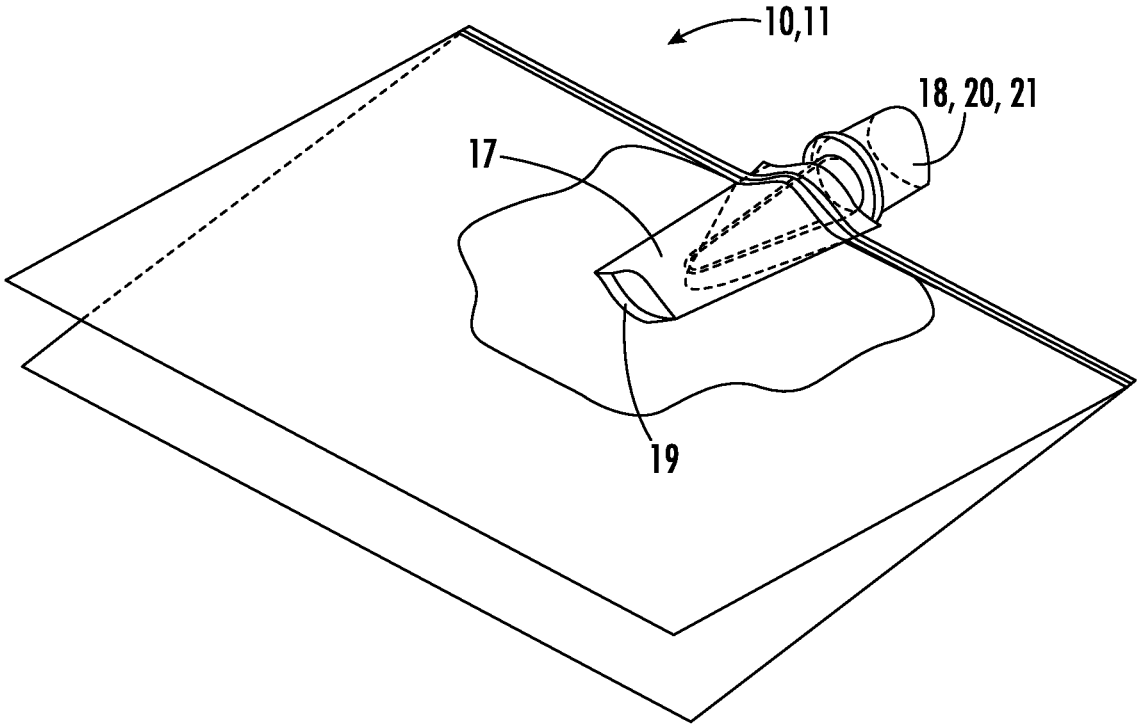
FIG. 3 is an isometric view of an example valve of an inflatable pillow according to the invention.

A first valve 18 is positioned in the intermediate chamber 16 and provides fluid communication with the intermediate chamber 16 for inflating and deflating the intermediate chamber 16. A second valve 20 is positioned in either the base chamber 12, as shown in FIG. 2, or in one or more of the support chambers 14 other than the intermediate chamber 16 as shown in FIG. 1. Advantageously, the valves 18 and 20 may be flush with the surfaces on which they are mounted to avoid discomfort or injury to the patient. Valves 18 and 20 may be simple check valves, or more sophisticated pressure relief valves which prevent over-inflation of pillow 10. Alternatively, as shown in FIG. 3, the air valves 18 and 20 may be integral to each pillow 10 and comprised of a flat tube 17. The flat tube 17 may be comprised of two layers of polymer film with two opposing edges welded together. The valves 18 and 20 may be placed along the edge of the pillow 10, between two layers of material that form a chamber 12, 14, 16, and may traverse a welded seam of the pillow 10. Because the pillow 10 may be adapted for low internal pressure, a strip of low-tack, adhesive 19 may be used to provide a more secure seal. Air pressure or mechanical prodding from the inflation device (e.g. pump, blower, compressed air source, etc.) may delaminate the adhesive 19, allowing air to enter the pillow 10. After the pillow 10 is inflated, the seal adhesive 19 may be secured. Mechanical separation via a tube or pin is suitable for deflation of the pillow 10.

As shown in FIGS. 1 and 2, a plurality of ducts, in this example two ducts 22 and 24, provide fluid communication between the base chamber 12 and respective support chambers 14 other than the intermediate chamber 16. Ducts 22 and 24 permit the base chamber 12 and the support chambers 14 to be inflated and deflated through the second valve 20. Ducts 22 and 24 may be simple openings between the base chamber 12 and the support chambers 14 or the ducts themselves may comprise valves. The ducts are sealed against the ambient.

Figure 4:
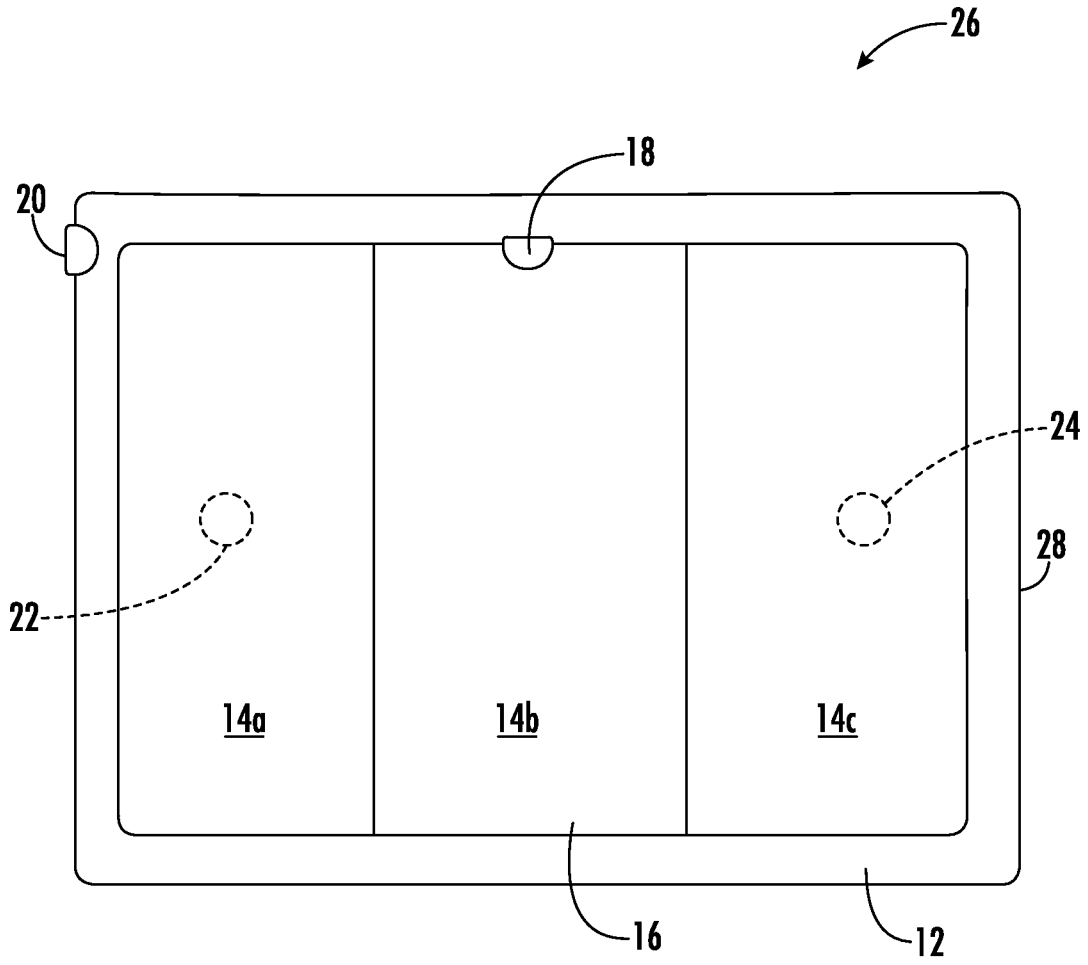
FIG. 4 is a plan view of another example embodiment of an inflatable pillow according to the invention.

FIG. 4 illustrates a pillow embodiment 26 wherein the base chamber 12 has an outer perimeter 28. The support chambers 14 are encompassed within the outer perimeter 28 of the base chamber 12. In this example the outer perimeter 28 has a rectangular shape. The rectangular shape is advantageous because it allows the pillow 26 to fit within a standard pillow case, and thus the outer perimeter 28 may have a width ranging from 18 inches to 19 inches and a length ranging from 24 inches to 25 inches when inflated. Pillow 26 is intended to support and partially immobilize an appendage (including the head and neck) and thus comprises no more than a first support chamber 14*a*, a second support chamber 14*b*, and a third support chamber 14*c*. The first, second and third support chambers 14*a*, 14*b* and 14*c* are arranged contiguous with one another. The second chamber 14*b*, comprising the intermediate chamber 16, is positioned between the first and second the support chambers 14*a* and 14*c* and is intended to directly support the appendage (such as the head) whereas the flanking support chambers 14*a* and 14*c* are intended to prevent the appendage from rotating and falling off of the intermediate chamber 16. This may be conveniently accomplished by under-inflating the intermediate chamber 16 relative to the support chambers 14*a* and 14*c*. By way of example each of the support chambers may have a width of 8 inches so as to fit within the perimeter of the base chamber 12. It is further considered that a maximum thickness of 3.5 inches is practical for both the support chambers 14*a*, 14*b* and 14*c* and the base chamber 12 when inflated.

Figure 5:
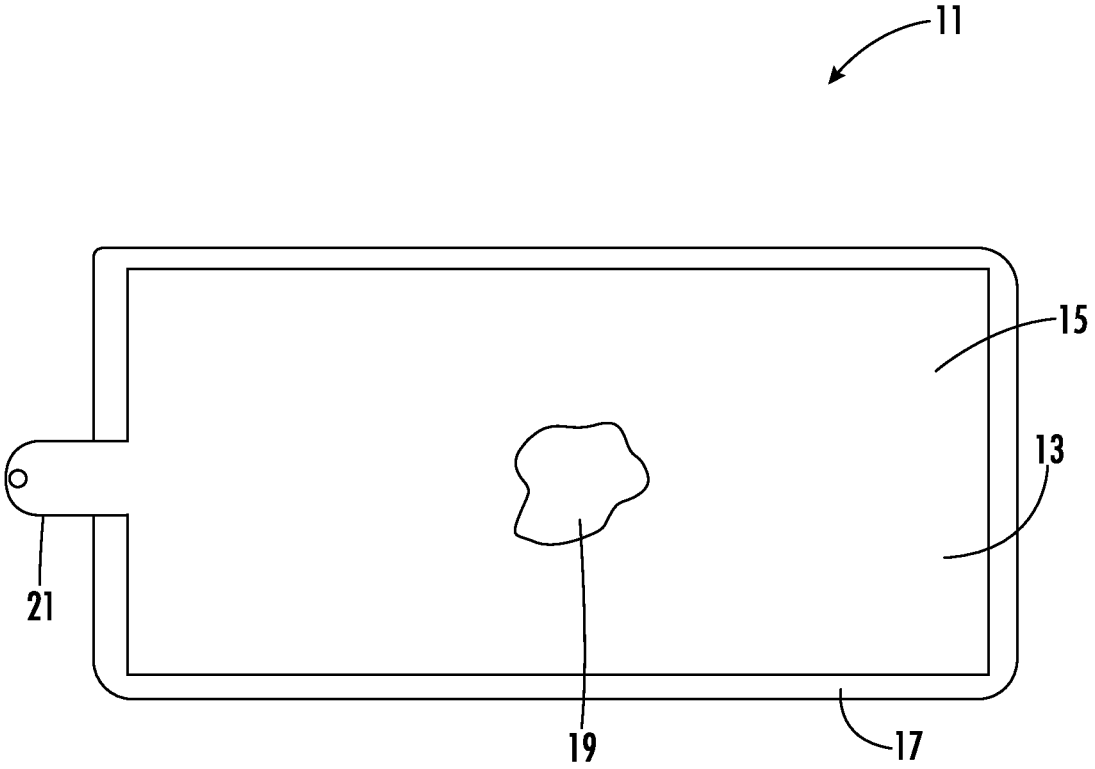
FIG. 5 is a plan view of another example embodiment of an inflatable pillow according to the invention.

FIG. 5 illustrates another example of an inflatable pillow 11 according to the invention. Pillow 11 comprises a single chamber bladder 13 formed of one or more gas impermeable substrates 15 joined by a plurality of gas-tight seams 17 to define an interior volume 19. A valve 21, for example, a check valve or a relief valve, is in fluid communication with the interior volume 19 to permit inflation and deflation of the bladder 13. Optionally, the valve 21 may be comprised of the flat tube 17 and adhesive seal 19 shown in FIG. 3. The substrates 15 may be formed of a fabric coated with thermoplastic polyurethane material or nylon to provide impermeable, hermetic characteristics allowing the bladder 13 to sustain a desired pressure at a low leak rate. When such material is used the seams 17 may be formed by heat fusing the substrates 15 to one another. Alternatively, the pillow 11 may be formed of a paper tissue (such as cellulose) or a natural and synthetic fabric with a polyester or polymer backing or textured polymer films. The seams of the pillow 11 may be formed from ultrasonic welding, heat welding, adhesives, or chemical weld-bonding agents.

In an example embodiment, pillow 11 would be approximately 18 inches×24 inches or 19 inches×25 inches to fit a standard pillowcase. The height will be variable to individualize patient needs and is determined by the dimensions of the substrates 15 as well as the degree of inflation of bladder 13. Pillows having other dimensions and shapes are also feasible, and the shape and size may be tailored for a particular implementation. Pillow 11 may have additional features to provide comfort of use while taking into consideration overpressure conditions using relief valve options. Valves 21 are advantageously formed flush to the substrate surfaces or integral to the pillow 11 to mitigate unnecessary hazards of compressive injuries to the patient. It is advantageous for substrates 15 to be formed of hypoallergenic, impermeable material which also meet standards for various pressure gradients.

Figure 6:
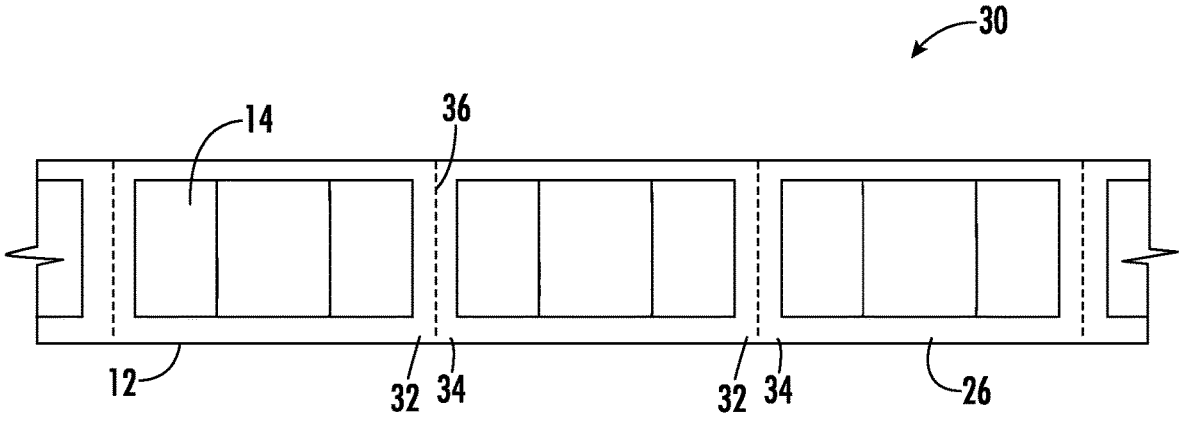
FIG. 6 is a plan view of a plurality of inflatable pillows of one example embodiment according to the invention forming a continuous web of indeterminate length.

FIG. 6 shows an example embodiment wherein a plurality of pillows 26 as described above form a continuous web 30. The base chamber 12 of each pillow 26 defines first and second edges 32 and 34 oppositely disposed from one another. In forming the web 30 the first edge 32 of at least one of the pillows is connected to a second edge 34 of another of the pillows. This pattern wherein edges are connected may be repeated for a large number of pillows. It is advantageous to cut a line of perforations 36 between the first and second edges to permit ready separation of the pillows 26 one from another. Alternatively, connected edges may be thinner than the base chamber 12 thickness to allow the connected edge to tear along the edge.

Figure 7:
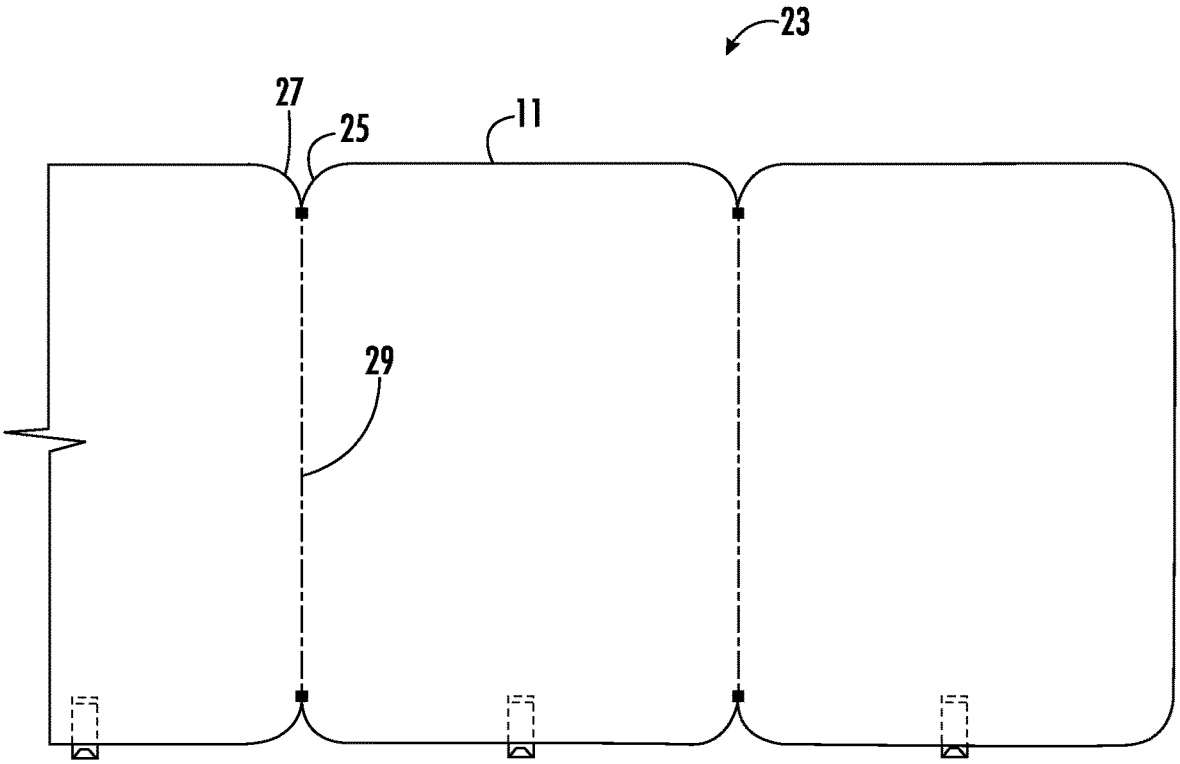
FIG. 7 is a plan view of a plurality of inflatable pillows of another example embodiment according to the invention forming a continuous web of indeterminate length.

Similarly, FIG. 7 shows an example embodiment wherein a plurality of pillows 11 form a continuous web 23. In forming the web 23 the first edge 25 of at least one of the pillows 11 is connected to a second edge 27 of another of the pillows. This pattern wherein edges are connected may be repeated for a large number of pillows. It is advantageous to cut a line of perforations 29 between the first and second edges to permit ready separation of the pillows 11 one from another. Alternatively, connected edges may be thinner than the combined layers of material forming the chamber of the pillow 11 to allow the connected edge to tear along the edge.

Figure 8:
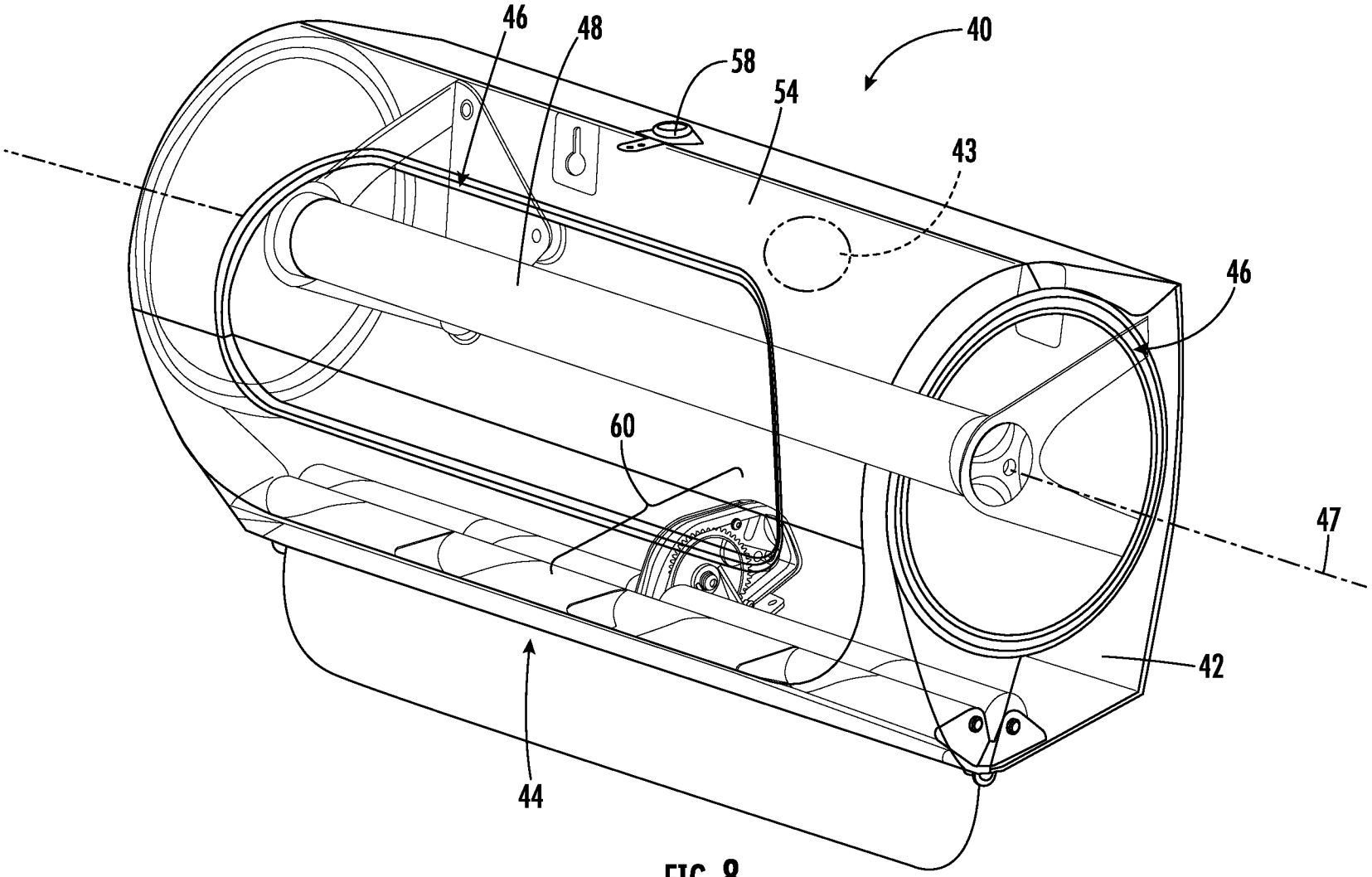
FIG. 8 is an isometric view of an example device for dispensing a web according to the invention.
Figure 9:
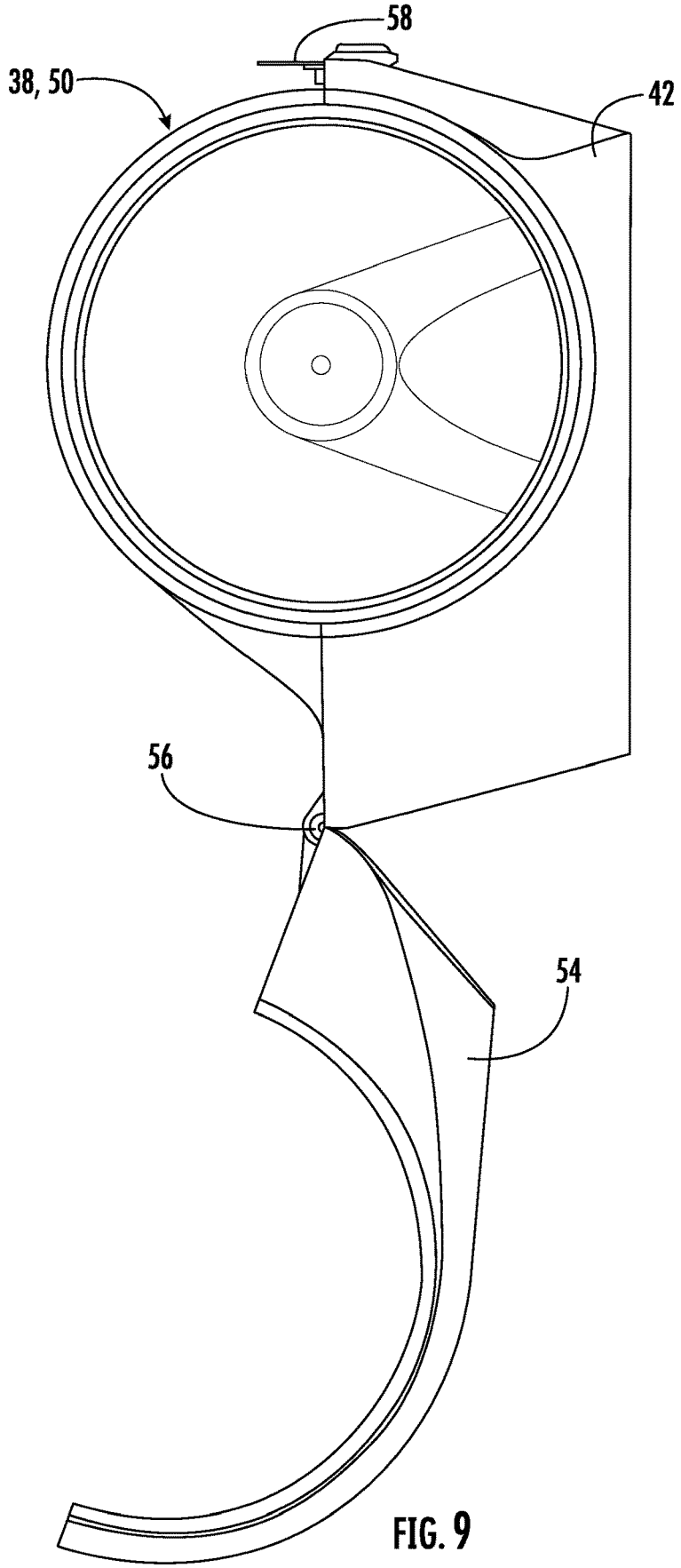
FIG. 9 is a side view of the example device of FIG. 8 with an example door in an open position.

As shown in FIGS. 8 and 9, a device 40 may be configured to dispense a web 50. The device 40 includes a housing 42 with a storage area 43 within to store the web 50 and an outlet 44 to dispense a free end 52 of the web 50 (shown in FIG. 10). In one aspect, the web 50 may be web 23 or 30 comprised of a plurality of pillows 10, 11 and 26. The web 50 may be coiled into a roll 38 and mounted on at least one shaft 48 attached to the housing 42. The roll 38 may be rotatable on the shaft 48 about a longitudinal axis 47. Alternatively, the shaft 48 may be rotatable about the longitudinal axis 47 and the roll 38 may be secured to the rod 48 so that the roll 38 rotates with the rod 48. Although not shown, alternatively, the web 50 may be folded. The housing 42 may include at least one viewing window 48 which may be a transparent portion of the housing 42 or an opening in the housing 42 to allow a user to see within the housing 42. With reference to FIGS. 8 and 9, the housing 42 may include a door 54 which may be locked and unlocked via a latch 58. As shown in FIG. 9, when unlocked, the door 54 may be opened and pivoted about a hinge 56 to provide access to the storage area 43 of the housing 42. When open, a user may load a new roll 38 and/or unload a used roll 38.

Figure 10:
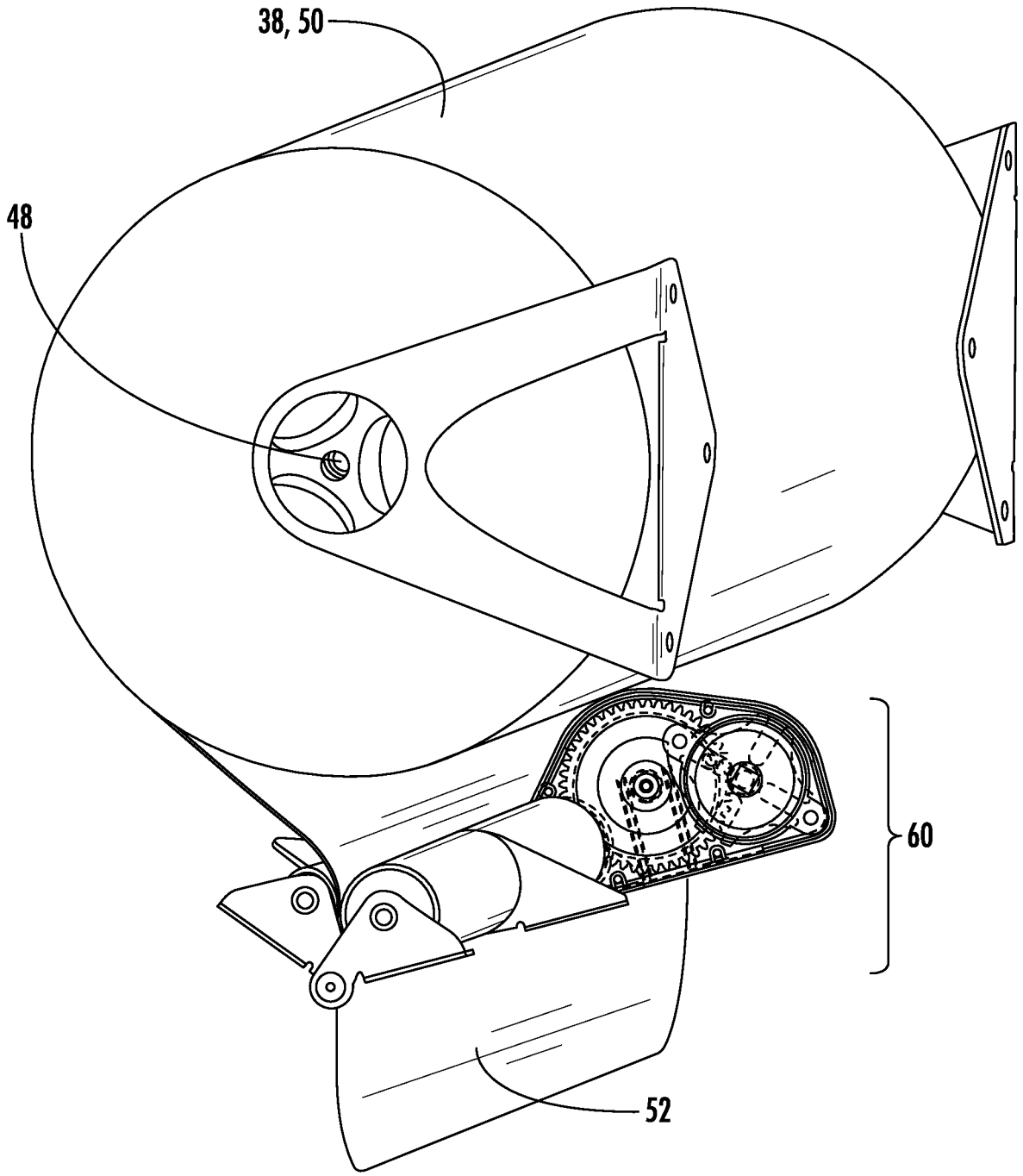
FIG. 10 is an isometric view of an example rolled web mounted on a shaft of an example device with a free end of the web fed through an example tensioning assembly.
Figure 11:
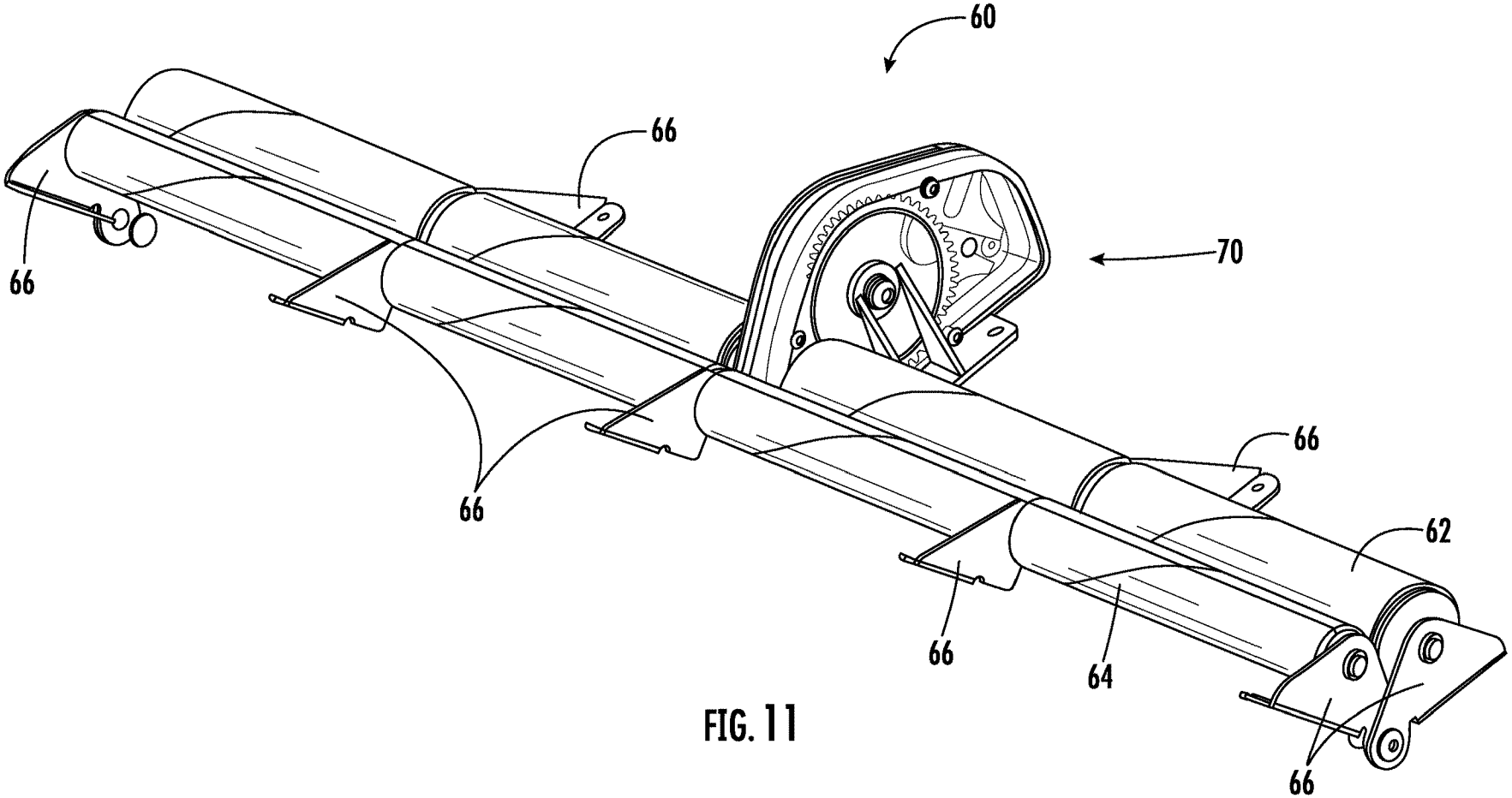
FIG. 11 is an isometric view of an example tensioning assembly of the device of FIG. 8.

As shown in FIG. 8, proximate to the outlet 44 is a tensioning assembly 60 configured to provide a tensioning force on the web 50 as the web 50 is pulled through the outlet 44 by a user. With reference to FIG. 10, the free end 52 of the web 50 or roll 38 is fed through the tensioning assembly 60. As shown in FIG. 11, the tensioning assembly 60 includes a roller 62 and a pinch roller 64 oppositely disposed and configured to pinch the web 50. Optionally, the roller 62 and pinch roller 64 may each comprise a plurality of rollers. A plurality of brackets 66 may couple the roller 62 and pinch roller 64 to the housing 42. The roller 62 and pinch roller 64 rotate as the web 50 is pulled between the roller 62 and pinch roller 64 to translate the downward motion of the web 50 into a gear train 70.

Figure 12:
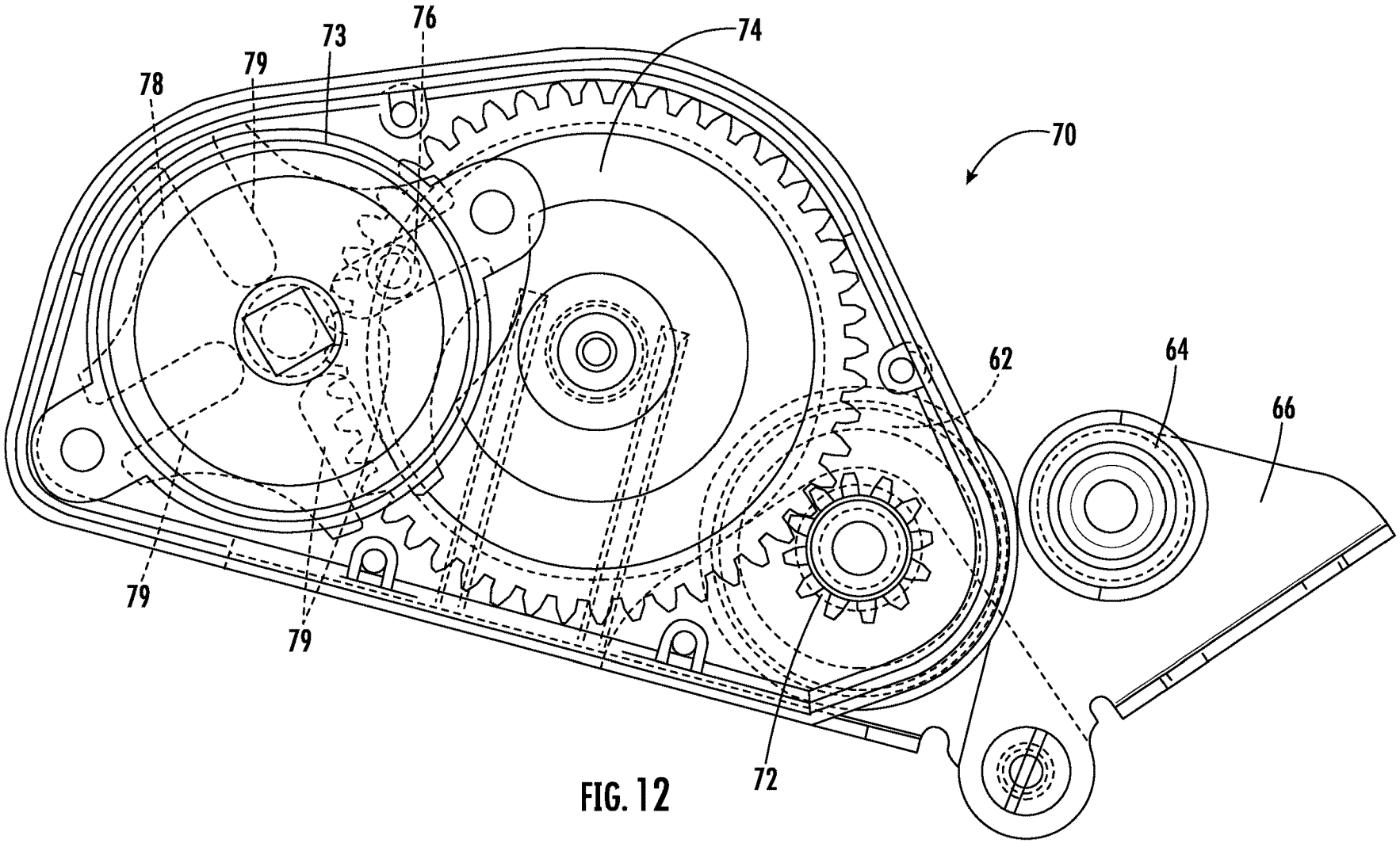
FIG. 12 is a side of an of an example gear train of the example tensioning assembly of FIG. 11.
Figure 13:
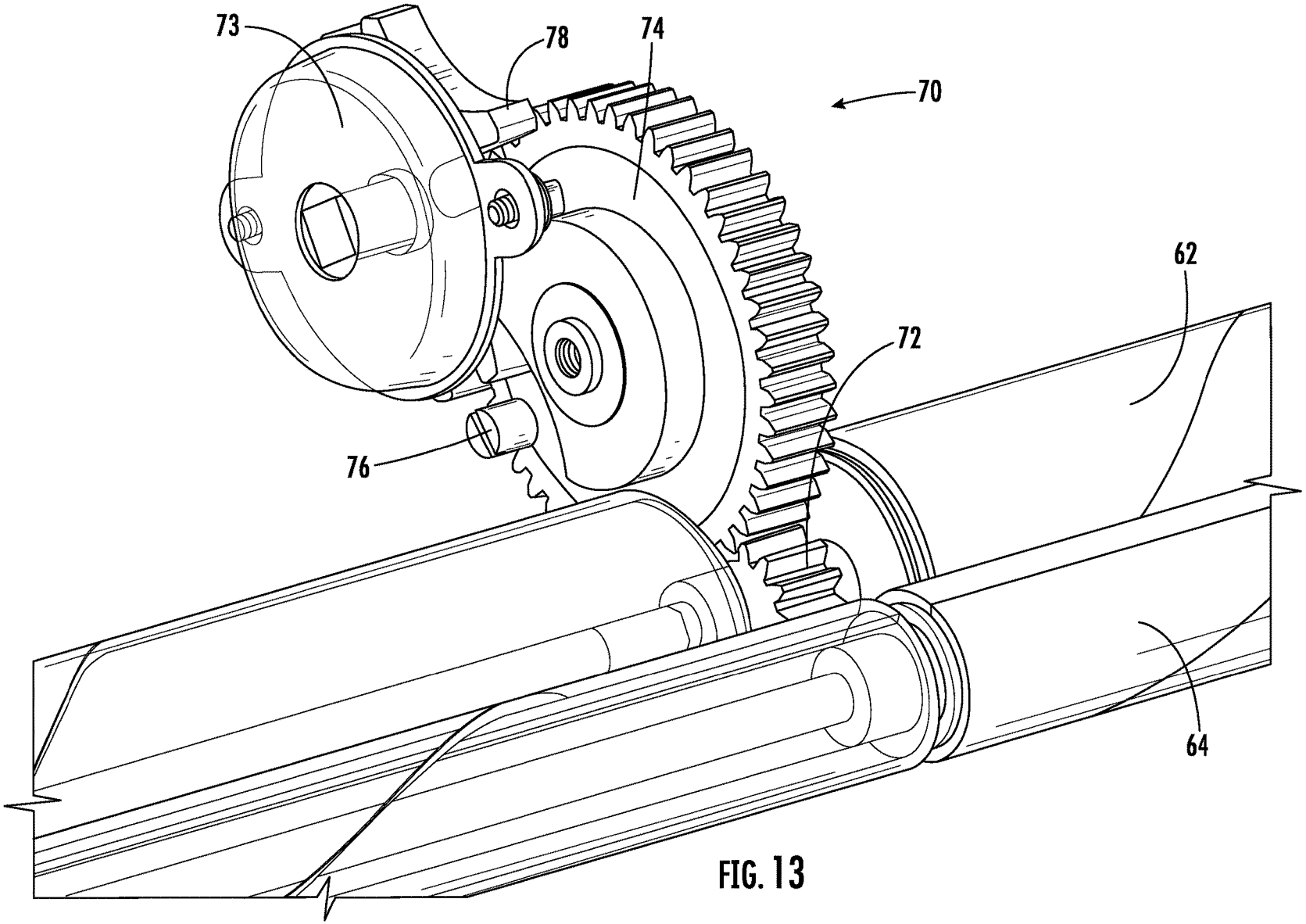
FIG. 13 is an isometric view of the example gear train.

As shown in FIGS. 12 and 13, the roller 62 is fixedly coupled to a pinion 72 so that rotation of the roller causes corresponding rotation of the pinion. The pinion 72 drives the gear train 70 including a Geneva mechanism. The gear train 70 includes at least one gear 74 including teeth that interlock with teeth of the pinion 72. The gear 74, including a pin 76, acts as a drive wheel to a Geneva wheel 78. The Geneva wheel 78 defines a plurality of slots 79. As the gear 74 rotates, the pin 76 on the gear 74 engages with a slot 79 of the Geneva mechanism 78 to rotate and advance the Geneva mechanism 78 one step or one position, which in this example, is a quarter turn. Although the example Geneva wheel 78 includes four positions at 90 degree angles, it is understood the Geneva wheel 78 of the device 40 may have more or fewer positions. Further, the gear ratio of the roller 62 to the pinion 72 may be such that four rotations of the roller 62 and corresponding rotation of the pinion 72 advances the gear 74 one full turn and the Geneva wheel 78 a quarter turn. In this example, four rotations of the roller 62 may correspond to a length or width of one pillow 10, 11, 26 from the web 50 or roll 38. The Geneva wheel 78 may be coupled to a resistance device 73, in this example, a hydraulic rotary speed damper. The resistance device 73 imparts a resistive torque as the Geneva mechanism 78 advances. This torque is translated through the gear train 70 and roller 62 to generate enough resistance to tear the dispensed pillow 10, 11, 26 at the existing perforation. As the pillow 10, 11, 26 is torn away, the Geneva mechanism 78 disengages and allows the roller 62 to spin free or relatively free of resistance as the next pillow 10, 11, 26 is removed. Optionally, the device 40 may include a cutter at or near the outlet 44 to tear away a dispensed pillow 10, 11, 26.

In a practical embodiment the pillow dispensing device 40 may also comprise an inflator, such as an air compressor or CO2 cartridge, adapted to inflate the pillows 10, 11, 26 after the pillow is dispensed or during dispensing of the pillow. A tank for holding a compressed gas is also feasible for convenient pillow inflation.

It is expected that pillows according to the invention along with dispensing devices as disclosed herein will allow for improved infection control practices, time management and comfort of patients while being sufficiently inexpensive to permit the pillows to be discarded after use or given to patients for home use.

All of the embodiments of the claimed invention described herein are provided expressly by way of example only. Innumerable variations and modifications may be made to the example embodiments described herein without departing from the concept of this disclosure. Additionally, the scope of this disclosure is intended to encompass any and all modifications and combinations of all elements, features, and aspects described in the specification and claims, and shown in the drawings. Any and all such modifications and combinations are intended to be within the scope of this disclosure.

What is claimed is:

1. A continuous web comprising a plurality of inflatable pillows secured edge to edge, each said pillow comprising:

a first pillow edge and a second pillow edge oppositely disposed;

at least two chambers each defining first and second chamber edges oppositely disposed;

a first valve providing fluid communication with at least a first chamber of said at least two chambers for inflating and deflating at least said first chamber of said at least two chambers;

a second valve providing fluid communication with at least a second chamber of said at least two chambers for inflating and deflating at least said second chamber of said at least two chambers; and at least one duct;

wherein said at least one duct provides fluid communication between said first of said at least two chambers and another of said at least two chambers, said at least one duct permitting inflating and deflating said another of said at least two chambers through said first valve;

wherein at least one of said at least two chambers may be inflated to a different level than another chamber of said at least two chambers;

wherein said first pillow edge of at least one of said plurality of inflatable pillows is connected to said second pillow edge of another of said plurality of inflatable pillows.

2. The continuous web according to claim 1, wherein said first pillow edge of said at least one of said plurality of inflatable pillows is connected to said second pillow edge of said another of said plurality of inflatable pillows along a line of perforations between said first pillow edge and said second pillow edge.

3. The continuous web according to claim 1, wherein said first pillow edge of said at least one of said plurality of inflatable pillows is connected to said second pillow edge of said another of said plurality of inflatable pillows along an adjoining edge having a thickness that is thinner than a thickness of portions of said first pillow edge and said second pillow edge that are adjacent to said adjoining edge.

4. The continuous web according to claim 1, wherein said web is coiled into a roll comprising said plurality of inflatable pillows.

5. The continuous web according to claim 4, wherein said roll includes a free end configured to be dispensed from a dispensing device.

6. The continuous web according to claim 1, wherein said first valve comprises a flat tube and an adhesive seal.

7. The continuous web according to claim 1, wherein said at least one chamber is formed of paper tissue with a polyester backing or natural and synthetic fabrics with a polymer backing or textured polymer films.

8. The continuous web of claim 1, wherein said first and second pillow edges of each said pillow comprise said first or second chamber edges of one of said at least two chambers.

9. The continuous web of claim 1, wherein at least one of said at least two chambers overlies another of said at least two chambers.

10. An inflatable pillow comprising:

a first pillow edge and a second pillow edge oppositely disposed, said inflatable pillow having a length extending from said first pillow edge to said second pillow edge;

a plurality of support chambers overlying a base chamber, at least one of said support chambers comprising an intermediate chamber, said intermediate chamber being positioned between two of said support chambers along said length of said inflatable pillow;

a first valve positioned in said intermediate chamber;

a second valve positioned in one of said base chamber or said support chambers other than said intermediate chamber; and a plurality of ducts, each said duct providing fluid communication between said base chamber and a respective one of said support chambers other than said intermediate chamber, said ducts permitting inflating and deflating said base chamber and said support chambers through said second valve.

11. A continuous web comprising, in combination:

a first inflatable pillow according to claim 10; and at least one additional pillow, said at least one additional pillow comprising a first pillow edge and a second pillow edge, wherein said first pillow edge of said first inflatable pillow is connected to said second pillow edge of said at least one additional pillow.

12. The continuous web according to claim 11, wherein said first pillow edge of said first inflatable pillow is connected to said second pillow edge of said at least one additional pillow along a line of perforations between said first and second pillow edges.

13. The continuous web according to claim 11, wherein said web is coiled into a roll comprising said first inflatable pillow and said at least one additional pillow.

14. The continuous web according to claim 13, wherein said roll includes a free end configured to be dispensed from a dispensing device.

15. The inflatable pillow of claim 10, wherein said intermediate chamber has a top surface oppositely disposed to and not in contact with said base chamber, and wherein at least one of said support chambers has a top surface oppositely disposed to and not in contact with said base chamber, wherein said chambers are inflated such that said top surface of said intermediate chamber is closer to said base chamber than said top surface of at least one of said support chambers is.

16. The inflatable pillow of claim 10, wherein said base chamber comprises an outer perimeter, and wherein said plurality of support chambers are encompassed within said outer perimeter of said base chamber.

* * * * *